United States Patent [19]

Watanabe et al.

[11] 4,407,552

[45] Oct. 4, 1983

[54] CONNECTOR UNIT

[75] Inventors: Masayuki Watanabe; Hiroshi Yamaya, both of Aichi; Hitoshi Kurohata, Komaki, all of Japan

[73] Assignee: Matsushita Electric Industrial Co., Ltd., Kadoma, Japan

[21] Appl. No.: 390,333

[22] Filed: Jun. 21, 1982

Related U.S. Application Data

[63] Continuation of Ser. No. 140,887, Apr. 16, 1980.

[30] Foreign Application Priority Data

May 18, 1978 [JP] Japan ..... 53-67665
Jan. 16, 1979 [JP] Japan ..... 54-3693

[51] Int. Cl.[3] ..... H01R 13/66

[52] U.S. Cl. ..... 339/143 R; 333/182; 339/147 R

[58] Field of Search ..... 339/143, 147; 333/182, 333/185

[56] References Cited

U.S. PATENT DOCUMENTS 3,456,215 7/1969 Denes ..... 333/182
3,961,294 6/1976 Hollyday ..... 339/143 R X
4,079,343 3/1978 Nijman ..... 339/143 R X
4,212,510 7/1980 Ritchie et al. ..... 339/197 R
4,215,326 7/1980 Hollyday ..... 339/147 R X
4,276,523 6/1981 Boutros et al. ..... 339/143 R X

FOREIGN PATENT DOCUMENTS 3016315 11/1981 Fed. Rep. of Germany ... 339/143 R
53-74290 7/1978 Japan ..... 339/143 R

*Primary Examiner*—Eugene F. Desmond
*Attorney, Agent, or Firm*—Amster, Rothstein & Engelberg

[57] ABSTRACT

A connector unit, which comprises an insulating housing carrying a plurality of connection pins planted therethrough and accommodating a dielectric plate formed with through-holes penetrated by the connection pins and provided on both sides with electrodes. Thus, a capacitor is connected between each connection pin and earth, so that the connector unit is capable of preventing external interference waves from being introduced through the connection pins into the electric apparatus and also preventing spurious waves generated within the electric apparatus from radiation to the outside through the connection pins.

8 Claims, 18 Drawing Figures

CONNECTOR UNIT

This is a continuation of application Ser. No. 140,887, filed Apr. 16, 1980.

FIELD OF THE INVENTION

This invention relates to connector units and, more particularly, to a connector unit for connecting high sensitivity electrical apparatuses such as audio sound systems and communication systems.

DESCRIPTION OF THE PRIOR ART

Figure 1:
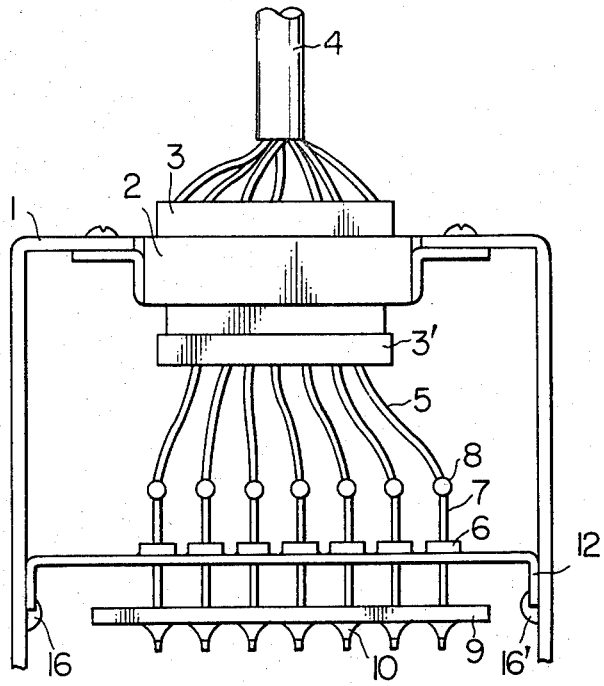
FIG. 1 is a side view showing a conventional connector unit of noise reduction type.

FIG. 1 shows a conventional electric apparatus having such a construction as to eliminate the introduction of external interference electromagnetic waves into it and radiation of spurious electromagnetic waves produced within it.

The construction of a conventional connector unit will now be described with reference to FIG. 1.

In FIG. 1, designated at 1 is a housing of the electric apparatus, and at 2 a male connector secured to the housing 1 and having a plurality of internally supported connection pins. Female connectors 3 and 3' are connected to the opposite sides of the male connector 2, and they have internally supported contactors, which support the connection pins of the male connector 2 between them. A cable 4 which connects electric apparatuses is connected to the individual contactors within the female connector 3, and electric wires 5 are connected to the individual contactors within the female connector 3'. Designated at 6 are through-holed capacitors, and each of the electric wires 5 is connected by solder 8 to an inner electrode 7 of each through-holed capacitor 6. The other end of the inner electrode 7 is connected by solder 10 to a print base board 9 which has an electric circuit formed by printing techniques or the like. Outer electrodes 11 of the individual through-holed capacitors 6 are connected by solder 15 to a conductor plate 12, which is in turn connected by solder 16 and 16' to the housing 1.

Figure 2:
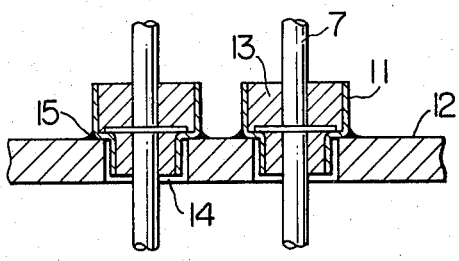
FIG. 2 is a partially enlarged cross sectional view showing the same unit.
Figure 3:
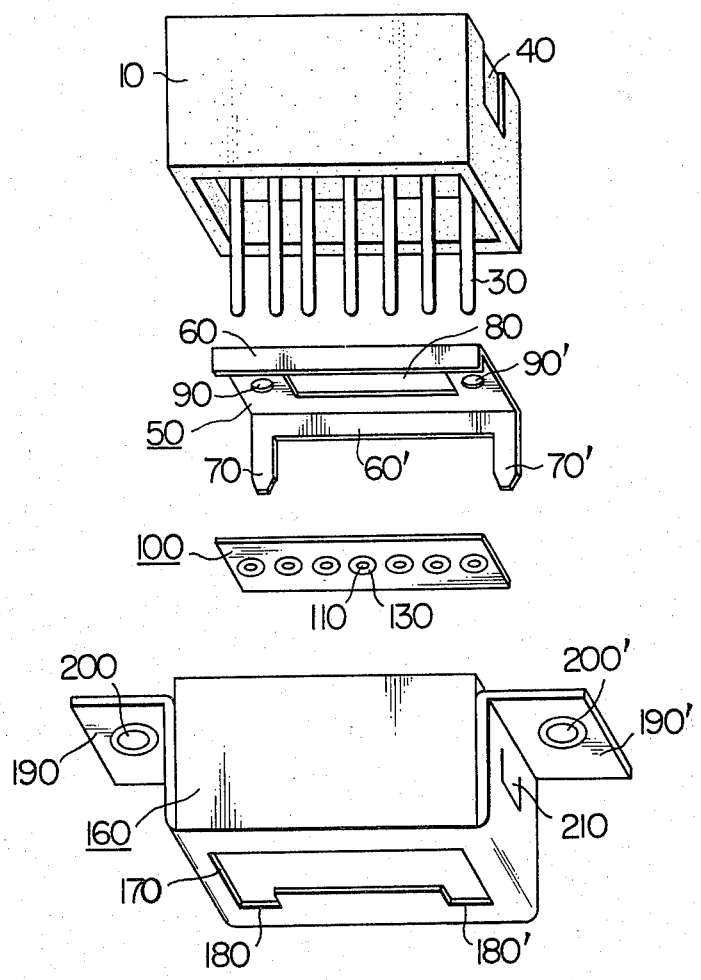
FIG. 3 is an exploded perspective view showing a first embodiment of the connector unit of noise reduction type according to the invention.
Figure 4:
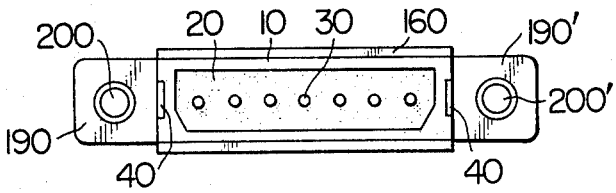
FIG. 4 is a top view of the same connector unit.
Figure 5:
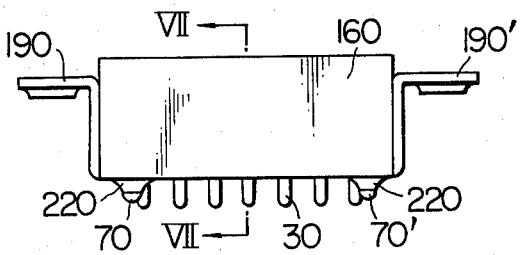
FIG. 5 is an elevational view of the same.
Figure 6:
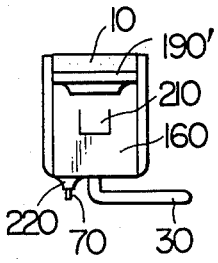
FIG. 6 is a side view of the same.

FIG. 2 is a partially enlarged cross sectional view of the connector unit shown in FIG. 1. The outer electrodes 11 of the through-holed capacitors 6, which are cylindrical, are inserted in through-holes 14 formed in the same conductor plate 12 and connected thereto by solder 15. Designated at 13 is a dielectric which is injected into each outer electrode 11.

The individual inner electrodes 7 penetrate the respective through-holes 14 formed in the conductor plate 12 without touching the plate and are insulated from one another.

In the above conventional construction of FIGS. 1 and 2, a capacitor block which comprises a plurality of capacitors 6 and a single conductor plate has to be provided between the connectors 2, 3 and 3' for connecting electric apparatuses and the print base circuit 9 constituting an electric circuit in order to eliminate the introduction of external interference electromagnetic waves and radiation of spurious electromagnetic waves.

The invention seeks to provide a connector unit, which includes capacitors or low-pass filters for eliminating the introduction of external interference electromagnetic waves and radiation of spurious electromagnetic waves.

SUMMARY OF THE INVENTION

An object of the invention is to provide a connector unit, which accommodates internal capacitors or low-pass filters each consisting of a capacitor and inductors so that it can eliminate the introduction of external interference electromagnetic waves into an electric apparatus and radiation of spurious electromagnetic waves produced within the electric apparatus.

DESCRIPTION OF THE PREFERRED EMBODIMENT

Referring now to FIGS. 3 to 8, designated at 10 is a rectangular insulating housing having an integral separation wall 20 provided inside it. Designated at 30 is a plurality of connection pins planted through the separation wall 20, and at 40 concave portions formed on the outer surface of the insulating housing 10. Designated at 50 is a conductor plate having opposite side bent portions 60 and 60', with the bent portion 60' having opposite end projections 70 and 70'. Designated at 80 is a rectangular hole formed in the conductor plate 50, and at 90 and 90' holes formed in the conductor plate 50 on opposite sides of the rectangular hole 80. The conductor plate 50 is inserted into the insulating housing 10 so that it extends along the underside of the separation wall 20. In this state, the individual connection pins 30 penetrate the rectangular hole 80 or hole 90 or 90' formed in the conductor plate 50.

Figure 8:
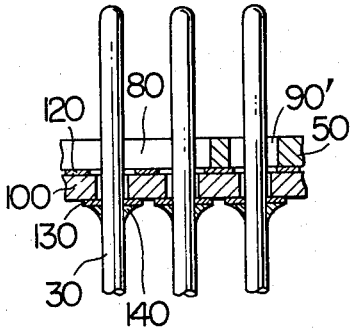
FIG. 8 is a partial sectional view of the same connector unit.

Designated at 100 is a dielectric plate formed with a plurality of holes 110, through which the connection pins 30 penetrate. Designated at 120 is a common electrode formed on the upper surface of the dielectric plate 100 except for portions surrounding the individual holes 110, and at 130 electrodes formed on portions of the lower surface of the dielectric plate 100 surrounding the holes 110. The dielectric plate 100 is disposed to extend along the underside of the conductor plate 50. In this state, the connection pins 30 are connected by solder 140 to the respective electrodes 130 (FIG. 8).

Designated at 150 is a resin injected into the lower space within the insulating housing 10, and the conductor plate 50 and dielectric plate 100 are completely shielded from the external environment by the injected resin.

Designated at 160 is a box-like case made by bending a conductive plate. The bottom of the case 160 is formed with a rectangular plate 170 together with cutsout 180 and 180' formed at opposite ends of one side of the hole 170. Designated at 190 and 190' are installation pieces secured to the opposite ends of the case 160 and having respective portions extending from the top of the case 160 in opposite directions and formed with respective holes 200 and 200'. Designated at 210 and 210' are tongues provided on the opposite ends of the case 160. These tongues 210 and 210' are slightly bent so that they extend into the case 160.

The resin-injected insulating housing 10, in which the conductor plate 50 and dielectric plate 100 are accommodated, is incased in the case 160, with the tongues 210 of the case 160 mated with the concave portions 40 of the insulating housing 10, so that the insulating housing 10 is held within the case 160.

Figure 7:
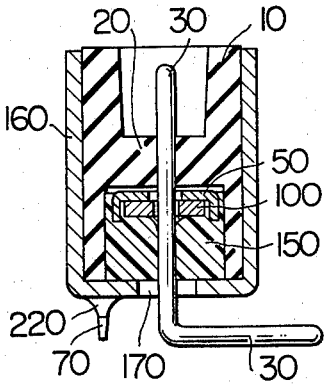
FIG. 7 is a sectional view taken along line VII—VII in FIG. 5.

In this state, the connection pins 30 project through the rectangular hole 170 formed in the bottom of the case 160 to the outside, and also the projections 70 and 70' of the conductor plate 50 project through the cutouts 180 and 180' formed in the bottom of the case 160. The projections 70 and 70' are connected by solder 220 to the case 160 (FIG. 7).

The portions of the connection pins 30 projecting from the bottom of the case 160 are bent if necessary.

The connector unit according to the invention is installed on a chassis of a communication apparatus or the like by making use of the installation pieces 190 and 190' and is connected to another apparatus by connecting contactors of another connector unit to the connection pins 30.

Figure 9:
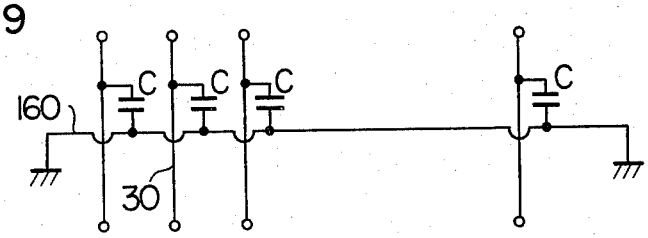
FIG. 9 is an electric circuit diagram of the connector unit according to the invention.

FIG. 9 shows the electric circuit of the connector unit according to the invention. Designated at C are capacitors, which are each formed by the common electrode formed on one side of the dielectric 100 and each electrode 130 formed on the other side of the dielectric 100. When the connector unit is installed on a chassis or the like, the capacitors C are each inserted between each connection pin 30 and earth, and through these capacitors external interference waves or internal spurious waves are high-frequency connected.

Figure 10:
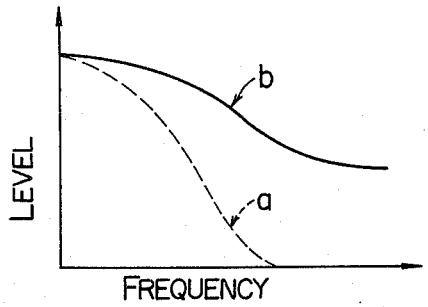
FIG. 10 is a graph showing a frequency characteristic of a conventional connector unit and that of the connector unit according to the invention.

FIG. 10 shows a frequency characteristic of the connector unit according to the invention and that of a conventional connector unit without having any dielectric plate. It will be seen that a high effect of reducing or eliminating high frequency components, as shown by curve a, can be obtained according to the invention compared to the conventional connector, as shown by curve b.

It is possible to omit the common electrode 120 formed on the dielectric plate 100 in the above embodiment and use the conductor plate 50 as one electrode of the capacitors.

With the construction according to the invention as described above, the following effects can be obtained.

(A) Since the dielectric plate is completely covered by the insulating housing and injected resin, the intrusion of external harmful gases, steam and so forth can be prevented to prevent damage to the dielectric plate and electrodes formed thereon.

(B) The injected resin can absorb external forces exerted to the connection pins and external vibration or impact and thus prevents damage to the dielectric plate and peel-off of the electrodes formed on the dielectric plate.

(C) The injected resin has an effect of alleviating sudden temperature changes of the external environment and thus preventing the peel-off of the electrodes on the dielectric plate.

Figure 11:
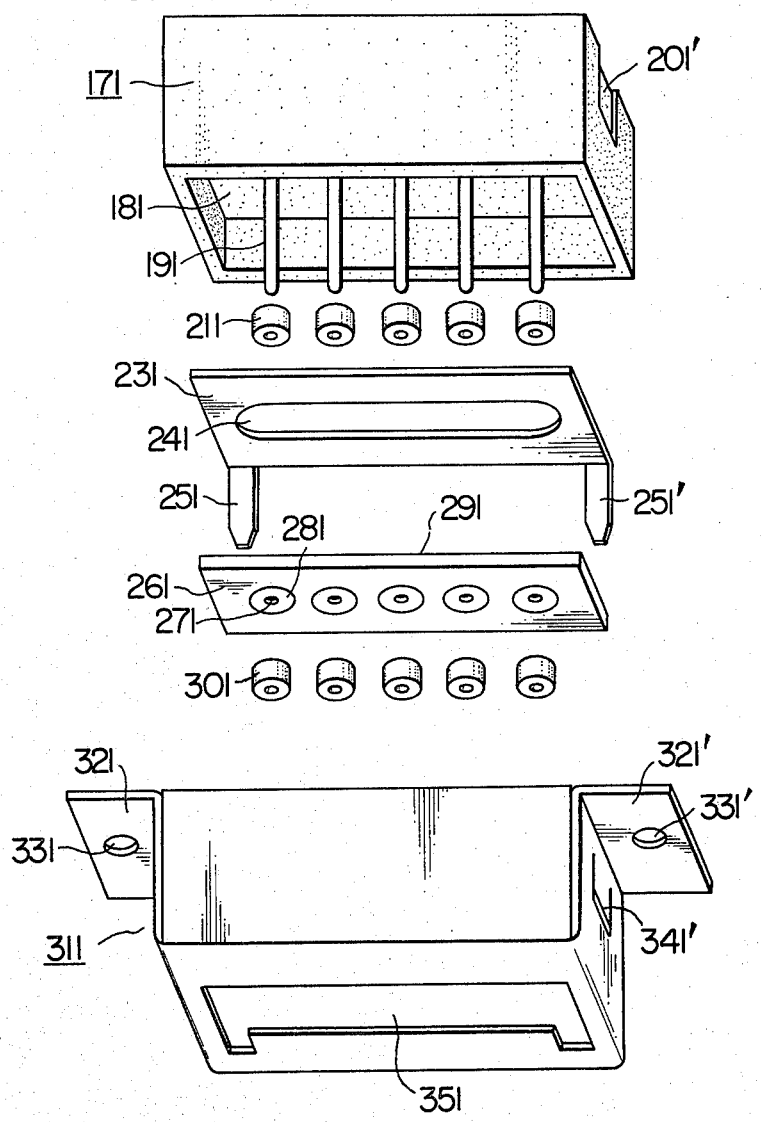
FIG. 11 is an exploded perspective view showing a second embodiment of the connector unit of noise reduction type according to the invention.
Figure 12:
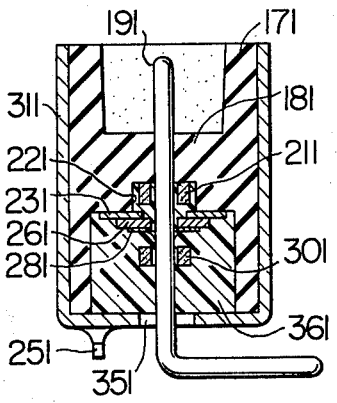
FIG. 12 is a sectional view of the same connector unit (a section take along line XII—XII in FIG. 15).
Figure 13:
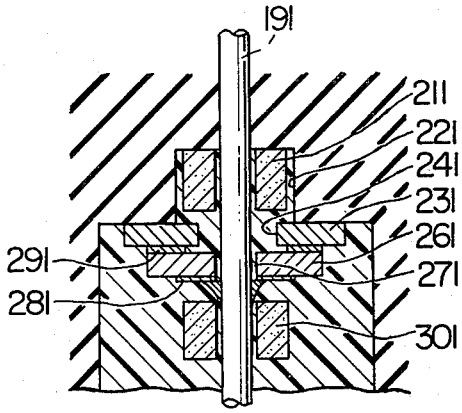
FIG. 13 is a partially enlarged cross sectional view of the same connector unit.
Figure 14:
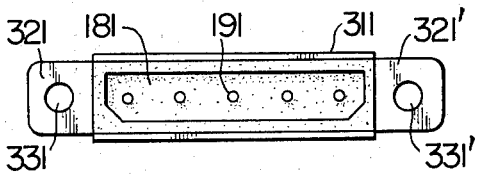
FIG. 14 is a top view of the same.
Figure 15:
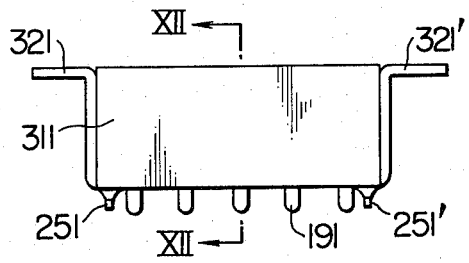
FIG. 15 is an elevational view of the same.
Figure 16:
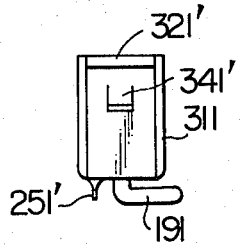
FIG. 16 is a side view of the same.

FIGS. 11 to 16 shows another embodiment of the invention. Referring to FIG. 11, designated at 171 is an insulating housing having an integral inside separation wall 181, through which a plurality of connection pins 191 are planted. Designated at 201 and 201' are grooves formed in upper portions of the opposite end outer surfaces of the insulating housing 171. Designated at 211 are cylindrical ferromagnetic members, which have an adequate magnetic permeability. The separation wall 181 is formed on its lower side with recesses 221 surrounding the respective connection pins 191, and the cylindrical ferromagnetic members 211 are received in these recesses 221 (FIGS. 12 and 13). Designated at 231 is a conductor plated formed with an elongate hole 241 and having integral projections 251 and 251' projecting from the opposite ends of one edge. Designated at 261 is a dielectric plate formed with through-holes 271, through which the respective connection pins 191 penetrate. Designated at 281 are electrodes individually formed on portions of the lower surface of the dielectric plate 261 surrounding the respective holes 271, and at 291 a common electrode formed on the upper surface of the dielectric plate 261 except for edge portions surrounding the holes 271. The electrodes 281 and common electrode 291 may be formed by printing techniques. Designated at 301 are cylindrical ferromagnetic members, at 311 a box-like shield case formed by bending a conductive plate, at 321 and 321' installation pieces secured to the opposite end outer surfaces of the shield case 311 and formed with respective holes 331 and 331', and at 341 and 341' mating tongues provided on the opposite ends of the shield case 311. The mating tongues 341 and 341' are slightly bent so that their lower portions are found within the shield case. Designated at 351 is a slot formed in the bottom of the shield case 311.

This connector unit is assembled in a manner as described below.

In the first place, the cylindrical ferromagnetic members 211 are fitted on the respective connection pins 191 and then inserted into the recesses 221 formed in the separation wall 181 on the lower side thereof. Then, the upper side of the dielectric plate 261 is secured by means of soldering to the underside of the conductor plate 231 to electrically connect the common electrode 291 formed on the upper surface of the dielectric plate 261 and the conductor plate 231 to each other. The conductor plate 231 and dielectric plate 261 which are thus made integral with each other are then inserted into the lower space within the insulating housing 171. The connection pins 191 are then passed through the slot 241 formed in the conductor plate 231 and the through-holes 271 formed in the dielectric plate 261, and the upper side of the conductor plate 231 is brought into contact with the underside of the separation wall 181. In this state, the individual electrodes 281 formed on the lower surface of the dielectric plate 261 are connected by means of soldering to the respective connection pins 191 penetrating the through-holes 271 of the dielectric plate 261. Subsequently, the cylindrical ferromagnetic members 301 are fitted on the respective connection pins 191, and then the lower space within the insulated housing 171 is filled with the injected resin 361, which is then solidified. In this state, lower portions of the connection pins 191 and projections 251 and 251' of the conductor plate 231 project from the underside of the injected resin 361. When this insulating housing 171 is inserted from above into the shield case 311, the mating tongues 341 and 341' provided on the opposite ends of the shield case 311 are engaged in the respective grooves 201 and 201' formed on the outer side of the opposite ends of the insulating housing 171, so that the detachment of the insulating housing 171 from the shield case 311 is prevented. With the insulating housing 171 inserted in the shield case 311, the connection pins 191 and projections 251 and 251' project from the slot 351 formed in shield case 311. In this state, the projections 251 and 251' are connected by means of soldering to the shield case 311. If necessary, the connection pins 191 are bent as shown in FIG. 12.

Figure 17:
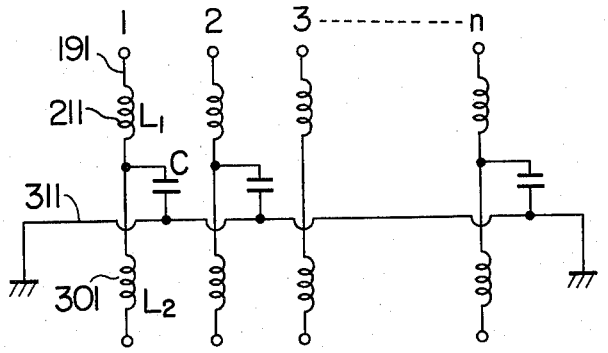
FIG. 17 an electric circuit diagram of the same connector unit.

FIG. 17 shows the electric circuit of the above embodiment. The ferromagnetic members 211 and 301 fitted on the connection pins 191 act as respective inductors $L_1$ and $L_2$, and the dielectric plate 261 acts as capacitors C. With the capacitors C connected between the respective connection pins 191 and shield case 311, low-pass filters are constituted by $L_1$, $L_2$ and C.

Figure 18:
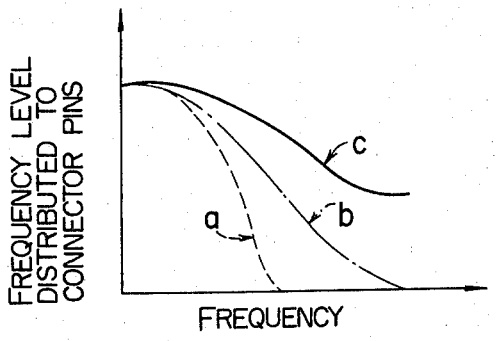
FIG. 18 is a graph showing frequency characteristics of connector units according to the invention and a conventional connector unit.

FIG. 18 shows frequency characteristics of various connector units. More particularly, curve a in FIG. 18 shows the characteristic of the above embodiment of the connector unit, curve b shows that the connector unit shown in FIGS. 3 to 8, which includes neither $L_1$ nor $L_2$ and is provided with the capacitors C alone, and curve c shows that of the conventional connector unit which does not include $L_1$, $L_2$ and C. The above embodiment has still superior effects of eliminating the intrusion of interference waves and radiation of spurious waves.

With the embodiment of FIGS. 11 to 16 the following effects can be obtained.

(A) Since the low-pass filters are accommodated, superior effects of eliminating the intrusion of interference waves and radiation of spurious waves can be obtained.

(B) Since electric apparatuses are connected through the built-in low-pass filters (LPF), the intrusion of interference waves and radiation of spurious waves can be suppressed in the neighborhood of the connector section of the electric apparatus.

(C) The construction is simple and can be readily assembled.

(D) Since the low-pass filters (LPF) are accommodated within the insulating housing and completely shielded from the external environment by the injected resin, they are perfectly protected from external vibrations and impacts harmful gases, steam, etc., and also effects of sudden changes of the external environment temperature on them can be alleviated. Thus, it is possible to maintain a steady and stable characteristic.

We claim:

1. A connection unit comprising:

an insulating housing having a separation wall;

a plurality of connection pins penetrating said separation wall;

a conductor plate formed with at least one projection and at least one hole of sufficient size to permit said connection pins to pass through said hole without making electrical contact with said conductor plate, said conductor plate being disposed within the insulating housing along the underside of said separation wall;

a dielectric plate formed with a plurality of holes which receive individual connection pins therethrough without making electrical contact with said connection pins, said dielectric plate being disposed within the insulating housing in contact with the underside of said conductor plate;

a plurality of conducting portions formed on the surface of said dielectric plate opposite the surface in contact with the conductor plate and surrounding said holes of the dielectric plate and in electrical contact with said connection pins, thereby effectively forming low-pass filters between said connection pins and conductor plate;

encapsulating resin filling the space within said insulating housing surrounding said conductor plate and said dielectric plate;

a conductive case having a bottom wall formed with at least one hole penetrated by said connection pins and said projection, said connection pins being disposed without making electrical contact with said conductive case and said conductive case accommodating said insulating housing therein; and means for electrically connecting said projection of the conductor plate to the outside of the bottom wall of said conductive case so as to provide an electromagnetic or magnetic shield by both of said conductor plate and conductive case, whereby said connector unit is electromagnetically or magnetically shielded by both of said conductor plate and conductive case and shielded from the external environment by the encapsulating resin.

2. A connector unit comprising:

an insulating housing having a separation wall;

a plurality of connection pins penetrating said separation wall;

a conductor plate formed with at least one projection and at least one hole of sufficient size to permit said connection pins to pass through said hole without making electrical contact with said conductor plate, said conductor plate being disposed within the insulating housing along the underside of said separation wall;

a dielectric plate formed with a plurality of holes which receive individual connection pins therethrough without making electrical contact with said connection pins, said dielectric plate being disposed within the insulating housing in contact with the underside of said conductor plate;

at least one first conducting portion formed on the surface of said dielectric plate in contact with the conductor plate except for portions surrounding said holes of the dielectric plate;

a plurality of second conducting portions formed on the surface of said dielectric plate opposite the surface in contact with the conductor plate and surrounding said holes of the dielectric plate and in electrical contact with said connection pins, whereby capacitors are effectively formed between said connection pins and conductor plate;

encapsulating resin filling the space within said insulating housing surrounding said conductor plate and said dielectric plate;

a conductive case having a bottom wall formed with at least one hole penetrated by said connection pins and said projection, said connection pins being disposed without making electrical contact with said conductive case and said conductive case accommodating said insulating housing therein; and means for electrically connecting said projection of the conductor plate to the outside of the bottom wall of said conductive case so as to provide an electromagnetic or magnetic shield by both of the conductor plate and conductive case, whereby said connector unit is electromagnetically or magnetically shielded by both of said conductor plate and conductive case and shielded from the external environment by the encapsulating resin.

3. A connector unit comprising:

an insulating housing having a separation wall;

a plurality of connection pins penetrating said separation wall;

a conductor plate formed with at least one projection and at least one hole of sufficient size to permit said connection pins to pass through said hole without making electrical contact with said conductor plate, said conductor plate being disposed within the insulating housing along the underside of said separation wall;

a dielectric plate formed with a plurality of holes which receive individual connection pins therethrough without making electrical contact with said connection pins, said dielectric plate being disposed within the insulating housing in contact with the underside of said conductor plate;

a plurality of conducting portions formed on the surface of said dielectric plate opposite the surface in contact with the conductor plate and surrounding said holes of the dielectric plate so as to be in electrical contact with said connection pins, whereby capacitors are effectively formed between said connection pins and conductor plate;

a plurality of cylindrical ferromagnetic members disposed within the insulating housing, at least one ferromagnetic member positioned coaxially with each connection pin, thereby effectively forming inductors with the connection pins;

encapsulating resin filling the space within said insulating housing surrounding said conductor plate, said dielectric plate and ferromagnetic members;

a conductive case having a bottom wall formed with at least one hole penetrated by said connection pins and said projection, said connection pins being disposed without making electrical contact with said conductive case and said conductive case accommodating said insulating housing therein; and means for electrically connecting said projection of the conductor plate to the outside of the bottom wall of said conductive case so as to provide an electromagnetic or magnetic shield by both of said conductor plate and conductive case, whereby said connector unit is electromagnetically or magnetically shielded by both of said conductor plate and conductive case and shielded from the external environment by the encapsulating resin.

4. A connector unit comprising:

an insulating housing having a separation wall;

a plurality of connection pins penetrating said separation wall;

a conductor plate formed with at least one projection and at least one hole of sufficient size to permit said connection pins to pass through said hole without making electrical contact with said conductor plate, said conductor plate being disposed within the insulating housing along the underside of said separation wall;

a dielectric plate formed with a plurality of holes which receive individual connection pins therethrough without making electrical contact with said connection pins, said dielectric plate being disposed within the insulating housing in contact with the underside of said conductor plate;

a plurality of conducting portions formed on the surface of said dielectric plate opposite the surface in contact with the conductor plate and surrounding said holes of the dielectric plate and in electrical contact with said connection pins, whereby capacitors are effectively formed between said connection pins and conductor plate;

a plurality of first cylindrical ferromagnetic members positioned coaxially with said respective connection pins and disposed within the insulating housing above the conductor plate, thereby effectively forming first inductors with the connection pins;

a plurality of second cylindrical ferromagnetic members positioned coaxially with said respective connection pins and disposed within the insulating housing below the dielectric plate, thereby effectively forming second inductors with the connection pins;

encapsulating resin filling the space within said insulating housing surrounding said conductor plate, said dielectric plate and ferromagnetic members;

a conductive case having a bottom wall formed with at least one hole penetrated by said connection pins and said projection, said connection pins being disposed without making electrical contact with said conductive case and said conductive case accommodating said insulating housing therein; and means for electrically connecting said projection of the conductor plate to the outside of the bottom wall of said conductive case so as to provide an electromagnetic or magnetic shield by both of the conductor plate and conductive case, whereby said connector unit is electromagnetically or magnetically shielded by both of said conductor plate and conductive case and shielded from the external environment by the encapsulating resin.

5. A connector unit comprising:

an insulating housing having a separation wall, said separation wall having recesses formed in the underside thereof;

a plurality of connection pins penetrating said separation wall;

a conductor plate formed with at least one projection and at least one hole of sufficient size to permit said connection pins to pass through said hole without making electrical contact with said conductor plate, said conductor plate being disposed within the insulating housing along the underside of said separation wall;

a dielectric plate formed with a plurality of holes which receive individual connection pins therethrough without making electrical contact with said connection pins, said dielectric plate being disposed within the insulating housing in contact with the underside of said conductor plate;

a plurality of conducting portions formed on the surface of said dielectric plate opposite the surface in contact with the conductor plate and surrounding said holes of the dielectric plate so as to be in electrical contact with said connection pins, whereby capacitors are effectively formed between said connection pins and conductor plate;

a plurality of first cylindrical ferromagnetic members positioned coaxially with said respective connection pins and received in said recesses surrounding said respective connection pins, thereby effectively forming first inductors with the connection pins;

a plurality of second cylindrical ferromagnetic members positioned coaxially with said respective connection pins and disposed within the insulating housing along the underside of the dielectric plate, thereby effectively forming second inductors with the connection pins;

encapsulating resin filling the space within said insulating housing surrounding said conductor plate, said dielectric plate and ferromagnetic members;

a conductive case having a bottom wall formed with at least one hole penetrated by said connection pins and said projection, said connection pins being disposed without making electrical contact with said conductive case and said conductive case accommodating said insulating housing therein; and means for electrically connecting said projection of the conductor plate to the outside of the bottom wall of said conductive case so as to provide an electromagnetic or magnetic shield by both of the conductor plate and conductive case, whereby said connector unit is electromagnetically or magnetically shielded by both of said conductor plate and conductive case and shielded from the external environment by the encapsulating resin.

6. A connector unit comprising:

an insulating housing having a separation wall;

a plurality of connection pins penetrating said separation wall;

a conductor plate formed with at least one projection and at least one hole of sufficient size to permit said connection pins to pass through said hole without making electrical contact with said conductor plate, said conductor plate being disposed within the insulating housing along the underside of said separation wall;

a dielectric plate formed with a plurality of holes which receive individual connection pins therethrough without making electrical contact with said connection pins, said dielectric plate being disposed within the insulating housing in contact with the underside of said conductor plate;

at least one first conducting portion formed on the surface of said dielectric plate in contact with the conductor plate except for portions surrounding said holes of the dielectric plate;

a plurality of second conducting portions formed on the surface of said dielectric plate opposite the surface in contact with the conductor plate and surrounding said holes of the dielectric plate and in electrical contact with said connection pins, whereby capacitors are effectively formed between said connection pins and conductor plate;

a plurality of cylindrical ferromagnetic members disposed within the insulating housing, at least one ferromagnetic member positioned coaxially with each connection pin, thereby effectively forming inductors with the connection pins;

encapsulating resin filling the space within said insulating housing surrounding said conductor plate, said dielectric plate and ferromagnetic members;

a conductive case having a bottom wall formed with at least one hole penetrated by said connection pins and said projection, said connection pins being disposed without making electrical contact with said conductive case and said conductive case accommodating said insulating housing; and means for electrically connecting said projection of the conductor plate to the outside of the bottom wall of said conductive case so as to provide an electromagnetic or magnetic shield by both of said conductor plate and conductive case, whereby said connector unit is electromagnetically or magnetically shielded by both of said conductor plate and conductive case and shielded from the external environment by the encapsulating resin.

7. A connector unit comprising:

an insulating housing having a separation wall;

a plurality of connection pins penetrating said separation wall;

a conductor plate formed with at least one projection and at least one hole of sufficient size to permit said connection pins to pass through said hole without making electrical contact with said conductor plate, said conductor plate being disposed within the insulating housing along the underside of said separation wall;

a dielectric plate formed with a plurality of holes which receive individual connection pins therethrough without making electrical contact with said connection pins, said dielectric plate being disposed within the insulating housing in contact with the underside of said conductor plate;

at least one first conducting portion formed on the surface of said dielectric plate in contact with the conductor plate except for portions surrounding said holes of the dielectric plate;

a plurality of second conducting portions formed on the surface of said dielectric plate opposite the surface in contact with the conductor plate and surrounding said holes of the dielectric plate so as to be in electrical contact with said connection pins, whereby capacitors are effectively formed between said connection pins and conductor plate;

a plurality of first cylindrical ferromagnetic members positioned coaxially with said respective connection pins and disposed within the insulating housing above the conductor plate, thereby effectively forming first inductors with the connection pins;

a plurality of second cylindrical ferromagnetic members positioned coaxially with said respective connection pins and disposed within the insulating housing below the dielectric plate, thereby effectively forming second inductors with said connection pins;

encapsulating resin filling the space within said insulating housing surrounding said conductor plate, said dielectric plate and ferromagnetic members;

a conductive case having a bottom wall formed with at least one hole penetrated by said connection pins and said projection, said connection pins being disposed without making electrical contact with said conductive case and said conductive case accommodating said insulating housing therein; and means for electrically connecting said projection of the conductor plate to the outside of the bottom wall of said conductive case so as to provide an electromagnetic or magnetic shield by both of said conductor plate and conductive case, whereby said connector unit is electromagnetically or magnetically shielded by both of said conductor plate and conductive case and shielded from the external environment by the encapsulating resin.

8. A connector unit comprising:

an insulating housing having a separation wall, said separation wall having recesses formed in the underside thereof;

a plurality of connection pins penetrating said separation wall;

a conductor plate formed with at least one projection and at least one hole of sufficient size to permit said connection pins to pass through said hole without making electrical contact with said conductor plate, said conductor plate being disposed within the insulating housing along the underside of said separation wall;

a dielectric plate formed with a plurality of holes which receive individual connection pins therethrough without making electrical contact with said connection pins, said dielectric plate being disposed within the insulating housing in contact with the underside of said conductor plate;

at least one first conducting portion formed on the surface of said dielectric plate in contact with the conductor plate except for portions surrounding said holes of the dielectric plate;

a plurality of second conducting portions formed on the surface of said dielectric plate opposite the surface in contact with the conductor plate and surrounding said holes of the dielectric plate so as to be in electrical contact with said connection pins, whereby capacitors are effectively formed between said connection pins and conductor plate;

a plurality of first cylindrical ferromagnetic members positioned coaxially with said respective connection pins and received in said recesses surrounding said respective connection pins, thereby effectively forming first inductors with the connection pins;

a plurality of second cylindrical ferromagnetic members positioned coaxially with said respective connection pins and disposed within the insulating housing along the underside of the dielectric plate, thereby effectively forming second inductors with the connection pins;

encapsulating resin filling the space within said insulating housing surrounding said conductor plate, said dielectric plate and ferromagnetic members;

a conductive case having a bottom wall formed with at least one hole penetrated by said connection pins and said projection, said connection pins being disposed without making electrical contact with said conductive case and said conductive case accommodating said insulating housing; and solder for electrically connecting said projection of the conductor plate to the outside of the bottom wall of said conductive case so as to provide an electromagnetic or magnetic shield by both of said conductor plate and conductive case, whereby said connector unit is electromagnetically or magnetically shielded by both of said conductor plate and conductive case and shielded from the external environment by the encapsulating resin.

* * * * *